United States Patent [19]

Scott et al.

[11] 4,287,511

[45] Sep. 1, 1981

[54] INTRUSION ALARM SYSTEM UTILIZING STRUCTURAL MOMENT DETECTOR AS INTRUSION SENSOR AND AS RECEIVER FOR MECHANICAL INTRUSION AND COMMAND SIGNALS

[75] Inventors: David R. Scott, Lancaster, Calif.; Thomas S. Rhoades, Colorado Springs, Colo.

[73] Assignee: Scott Science and Technology, Inc., Lancaster, Calif.

[21] Appl. No.: 86,772

[22] Filed: Oct. 22, 1979

[51] Int. Cl.[3] ..... G08B 13/10

[52] U.S. Cl. ..... 340/541; 340/531; 340/666

[58] Field of Search ..... 340/531, 541, 666, 665; 307/119; 73/786, 775, 774

[56] References Cited

U.S. PATENT DOCUMENTS 3,534,356 10/1970 Bagno ..... 340/665

*Primary Examiner*—Glen R. Swann, III

*Attorney, Agent, or Firm*—Drummond and Nelson

[57] ABSTRACT

Structural moment detectors are carried by structural components, such as floors, walls, etc., within a desired secure area of a building structure. The structural moment detector detects deflections of the various structural members in response to changes of the loading of structural members caused by the intruder and generates signals which are transmitted to a control center which receives the intrusion signals and generates alarm signals.

The intrusion signals are transmitted to the control center through the building structure as impulsive loads applied to the building structure by transducers located in the secure area which are responsive to the signals generated by the structural moment detectors.

The alarm signals generated in the control center are transmitted to security system located in the secure area, such as automatic door locking mechanisms, lights, audible alarms, disabling gas injecting systems, etc., by means of coded impulsive loads applied to the building structure by transducers located in the control center which are responsive to the intrusion signals.

4 Claims, 4 Drawing Figures

$R_1$ = 4990 OHM
$R_2$ = 20 OHM
$T_1$ = $T_2$ = 2N2222
OR EQUIVALANT
LED = LIGHT EMITTING DIODE $R_1$ $R_2$ = 1 MEG OHM
R = $R_3$ = 2K OHM
$R_4$ ≈ 2K OHM
$C_1$ = .015 μFARAD
PV = PHOTOVOLTAIC CELLS

INTRUSION ALARM SYSTEM UTILIZING STRUCTURAL MOMENT DETECTOR AS INTRUSION SENSOR AND AS RECEIVER FOR MECHANICAL INTRUSION AND COMMAND SIGNALS

FIELD OF THE INVENTION

This invention relates to intrusion alarm systems for detecting entry of unauthorized persons into a defined secure area within a building structure.

More particularly, the invention relates to intrusion alarm systems employing a structural moment detector to generate intrusion signals which are transmitted to a control center where the alarm signals are initiated.

In yet another aspect, the invention pertains to an intrusion alarm system in which intrusion signals generated in a secure area are transmitted to a control center for processing as coded impulsive forces applied to and transmitted by the building structure housing the secure area.

In yet another aspect, the invention pertains to intrusion alarm systems in which alarm signals are transmitted as coded impulsive forces from the control center through the building structure to activate various security systems in the secure area.

BACKGROUND OF THE PRIOR ART

The function of an intrusion alarm system is to detect an unauthorized entry into a defined secure area and to transmit this information to a specific control point. Specific advantageous characteristics of a security system are the ability to differentiate between human intruders and a potentially harmless intruder such as an animal; the ability to minimize the number of false alarms; the ability to prevent an override or bypass; and the ability to operate during adverse environmental conditions such as power failure, electrical storms, and prolonged temperature variations. The security system can be considered to consist of three basic subsystems: (1) intrusion sensor; (2) the control center; and (3) local and remote security systems.

DESCRIPTION OF THE PRIOR ART

Intrusion sensors are classified as either perimeter detectors or volumetric space detectors. Perimeter intrusion sensors essentially consist of different types of switches, such as the common magnetic switch, which are strategically located around the perimeter of the region to be secured. The other three most common perimeter devices are the mat switch, the metallic window foil, and the perimeter light beam. A more sophisticated perimeter intrusion sensor is the vibration switch which provides a signal when strong structural vibrations, such as hammering or sawing, are occurring. The most common disadvantages associated with the perimeter intrusion sensors are the fact that the devices are basically one or two dimensional and do not sense the entire volume to be secured, the sensors are quite easily "jumped" electrically, and they usually require considerable wiring to implement.

The space intrusion sensor is designed to detect a violation of a volumetrical region. The basic principle of operation of prior art space intrusion sensors includes the generation and transmission of a stable energy field throughout the volume which when disturbed by the entry of a human, causes a receiving device to generate an alarm signal. Such devices have a degree of invulnerability since one must pass through the secure area in order to come in physical contact with the equipment. Most of the volumetric intrusion sensors employ the physical principle known as the Doppler Shift. A large number of sensors have been developed which operate in various segments of the acoustic and electromagnetic spectrum. Some examples are:

(1) Acoustic sensors operating in the region of 4,000 to 8,000 Hz.

(2) Ultrasonic devices operating in the region of 15,000 to 40,000 Hz.

(3) Ultrahigh electromagnetic frequency devices operating at 915 megahertz, basically a microwave device.

(4) Microwave devices operating at 2.5 to 10 giga hertz.

Table 1 provides some information on prior art space intrusion sensors.

TABLE 1

PRIOR ART SPACE INTRUSION SENSORS

| Sensor Type | Method of Operation | Range of Operation | Comments |
|---|---|---|---|
| Audio Detection | Listens to sounds | 25 ft. radius | Blocked by walls, triggered by extraneous noises |
| Sonic | 4,000 to 9,000 Hz transmitted and received Doppler Signal | 25 ft. radius | Blocked by solid objects, triggered by moving objects |
| Ultransonic | 15,000 to 40,000 Hz. | 15–30 ft. radius | Same as sonic |
| Microwave | 915 HHz, transmitted and received Doppler Signal | 20 ft. radius | Will go through walls, blocked by metal, may trigger on extraneous radio transmissions, FFC certification required |
| Microwave | 2.5–10 giga hertz transmitted and received Doppler Signal | Up to 75 ft. | Go through most solids, interface with commercial radar systems, may be used outdoors |
| Infrared | Passive detector sensing heat changes | 15 ft. radius | Will not sense through solids, triggered on hot spots (sun, etc.) |
| Stress | Resistive changes resulting from flexure in structural members | 15 ft. radius | Sensor mounted to structural members, less affected by extraneous noise sources |
| Capacity | Senses changed capacity in a tuned circuit | 2 ft. radius | Excellent short-ranged detection |
| Ambient Light | Light levels detected by photovoltaic cells | 10 ft. radius | Requires lighted area not subject to changes in outside ambient light levels |
| Closed Circuit TV | TV camera system | 50 ft. radius | Requires human observer |
| Seismic | Low frequency ground | 50 ft. radius | Outdoor use primarily, may be triggered |

TABLE 1-continued

| PRIOR ART SPACE INTRUSION SENSORS | | | |
|---|---|---|---|
| Sensor Type | Method of Operation | Range of Operation | Comments |
| | vibration | | by environmental earth noise. |

It is possible to use the other intrusion characteristics of matter such as charge, mass, reflectivity, and weight to construct a sensor. In all cases, the prior art space intrusion sensors either generate a field or sense the energy field generated by the intruder. In general, the range of these sensors have been such that numerous sensors had to be employed to cover reasonably sized protected areas.

One of the major problems with any security system is the minimization of false alarms. False alarms can be generated by a wide variety of causes depending upon the operational mode of the detector. In order to attempt to minimize and eliminate false alarms, space intrusion detectors usually employ sophisticated electronic circuitry to process the basic intrusion signals received from the detector prior to giving an alarm signal. Such processing can take several forms. In Doppler systems, a velocity gate is sometimes employed which ignores all objects which are travelling at an extremely high or low rate of speed. Also, circuits which employ integration or event counting circuitry also help to reduce the possibility of false alarms. However, space intrusion detectors have a higher false alarm rate in general, due to the more sophisticated technology used.

In some cases, the signal detection and classification is not done at the locality of the sensor, but is done at the central location of the control center. This is especially true when the control center has some capability of performing decisions such as a small computer or microprocessor. The primary function of the control center is to take the alarm signal and activate the necessary alarms and initiate the series of actions which must be taken in case the secure area is violated.

Once an intrusion has been detected by a sensor and processed by the control center, it is necessary to activate alarms which indicate that the intrusion is in progress and it is necessary to activate other security systems located in the secure area such as audible alarms, automatic door locking mechanisms, lights, disabling gas injecting systems, etc.

Transmission of the intrusion signals from the secure area to the control center and transmission of the alarm signals from the control center back to the secure area to activate security systems therein is usually accomplished via electrical wiring communicating between the intrusion sensors and the alarm center and between the alarm center and the security systems. Such prior art communications between the alarm system components are often vulnerable to various disabling techniques and are, themselves, the source of possible false alarms.

It would be highly advantageous to provide improved intrusion alarm systems in which the intrusion sensors have improved range, selectivity, reliability, and reduced tendency to generate false intrusion signals.

Additionally, it would be highly advantageous to provide intrusion alarm systems in which the communications between the alarm system components are accomplished by means less vulnerable to tampering and which themselves have a reduced tendency to generate false intrusion or alarm signals.

Accordingly, it is a principal object of the present invention to provide improved intrusion alarm systems.

Another object of the invention is to provide improved intrusion alarm systems which employ intrusion detectors of improved range, selectivity, reliability, and reduced tendency to generate false intrusion signals.

Yet another object of the invention is to provide improved intrusion alarm systems in which communications between the components of the system are less vulnerable to tampering and have a reduced tendency to generate false signals.

These and other, further and more specific objects and advantages of the invention will be apparent to those skilled in the art from the following detailed description thereof, taken in conjunction with the drawings, in which.

SUMMARY OF THE INVENTION

Figure 1:
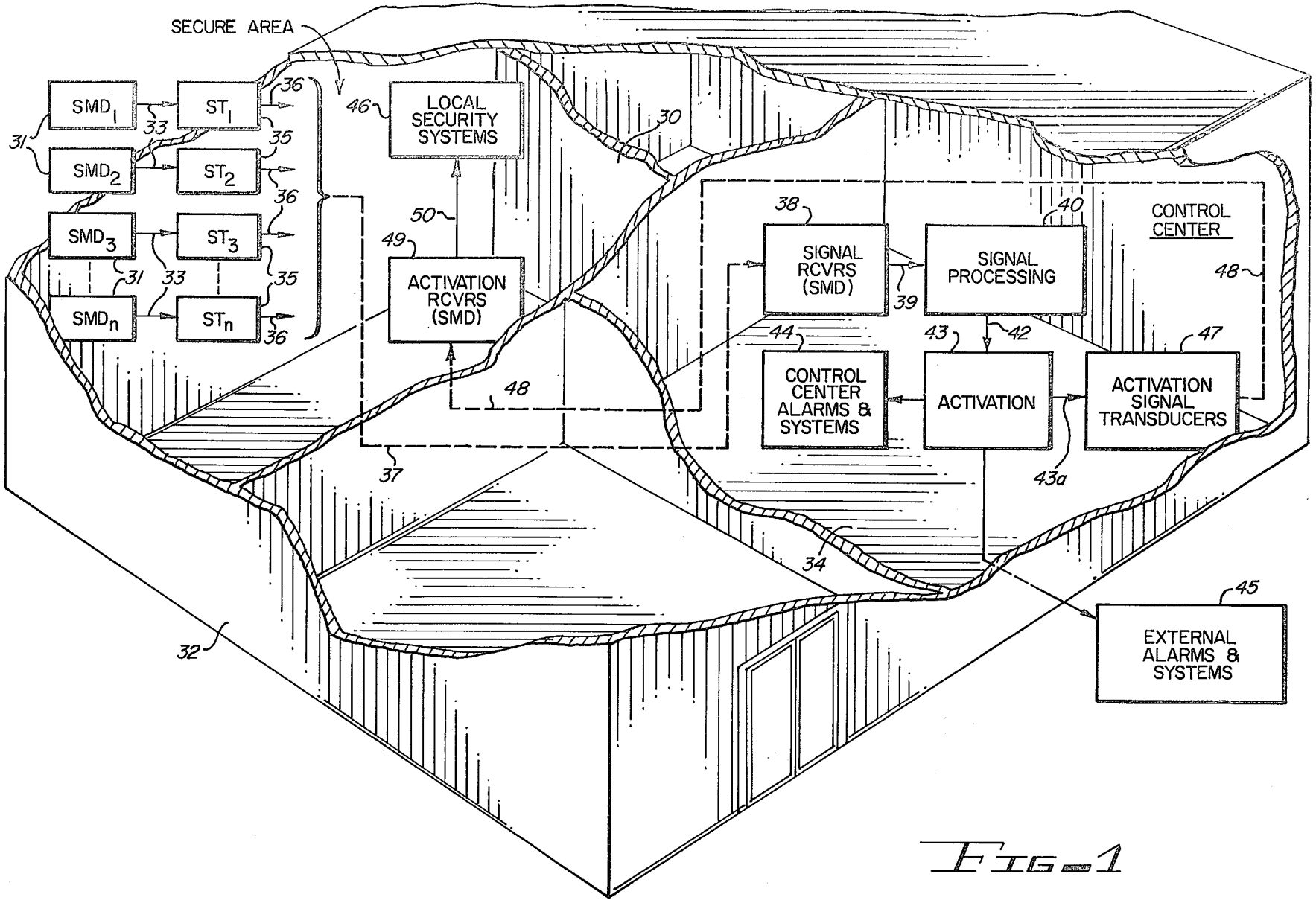
FIG. 1 is a schematic diagram illustrating the operation of intrusion alarm systems embodying the present invention.

Briefly, in accordance with our invention, we provide an intrusion alarm-security system for detecting unauthorized entry of persons into a defined secure area within a building structure. Signals are generated in response to an intrusion to activate security systems in response to the intrusion signals. Our system comprises at least one structural moment detector carried by a structural component of the building located within the secure area. The structural moment detector generates intrusion signals in response to the deflection of the structural member which is induced by changes of the loading on the member caused by an intrusion. Means are provided for transmitting the intrusion signals to a control center and means are provided in the control center for receiving the intrusion signals and for generating security system activation signals in response to the intrusion signals.

According to another embodiment of the invention, we provide improvements in prior art intrusion alarm systems which normally include sensor means for detecting the intrusion and generating intrusion signals in response thereto, control means responsive to the intrusion signals for generating alarm signals and means for transmitting the intrusion signals to the control means. The improvement comprises transducer means in the secure area for converting primary intrusion signals from the intrusion sensors to mechanical impulses and for applying the impulses to the building structure. A structural moment detector carried by the building structure senses deflections of the building structure by these impulses and generates secondary intrusion signals which are transmitted to the control means.

In yet another embodiment of the invention, we provide improvements in prior art building security systems which normally include control means for generating security component activation signals, security systems components located within a secure area of the building and means for transmitting the activation signals from the control means to the security system components. According to this embodiment, the improvements comprise transducer means for converting primary activation signals received from the control means to mechanical impulses and for applying the impulses to the building structure. A structural moment detector carried by the building structure in the secure area senses deflections of the structure by the impulses and generates secondary activation signals. Means are provided for transmitting the secondary activation signals to the security system components.

In still another preferred embodiment of the invention, communications in both directions between the intrusion sensors and the control means are provided by transducers which convert the signals to mechanical impulses and apply them to the building structure. Structural moment detectors detect these impulses and generate signals which are applied, respectively, to the control means and to activate the security system components.

Figure 2:
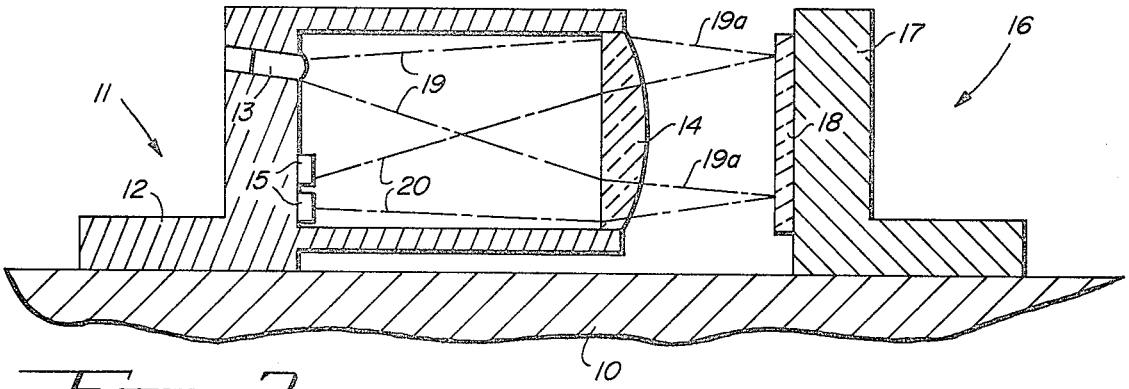
FIG. 2 is a sectional view of a structural moment detector which serves as the intrusion sensor according to a preferred embodiment of the invention.

As used herein, the term "structural moment detector" means a device which measures the integral of the moment between two points on the building structure. Such devices are known in the art, but for clarity will be briefly described in FIGS. 2–4 and the accompanying descriptive material. The structural moment detector is basically an autocollimator that is insensitive to linear dynamic motions but responds to angular deflection of one end of the sensor with respect to the other. Referring to FIGS. 2, the structural moment detector consists of two separate parts which are mounted at spaced locations on a beam 10. One of the parts 11 is a support bracket 12 which carries a light-emitting diode (LED) 13, a collimating lens 14 and dual photovoltaic detectors 15. The other part 16 of the structural moment detector consists of a support bracket 17 which carries a plane front mirror 18. The two parts 11 and 16 are suitably joined by a bellows or other hood member (omitted for clarity of illustration) to exclude extraneous light. The LED 13 emits an infrared light beam 19 which is collimated by the collimating lens 14. The collimated light beam 19*a* impinges on the mirror 18 and, as indicated by the dashed lines 20, is reflected back through the collimating lens 14 to the photovoltaic cells 15. Angular motions, but not linear motions, of the mirror 18 result in varying amounts of infrared radiation reaching each of the photovoltaic cells 15. The difference in voltage output of the photovoltaic cells 15 is then proportional to the angular motion of the mirror 18 with respect to the cells 15.

When mounted on structural building components such as floor, ceiling or wall beams, such structural moment detectors can measure the deflection of the beam with a resolution of 1 milliarc second ($10^{-9}$ radians) with a range of $\pm 10$ arc seconds. Where such accuracy is not required, such devices can be fabricated which have a resolution of at least 1 arc second with a dynamic range of $\pm 3°$. Such devices are capable of operating from DC to 50 KHz, the upper limit being established by the frequency limitation of the photovoltaic cells.

Figure 3:
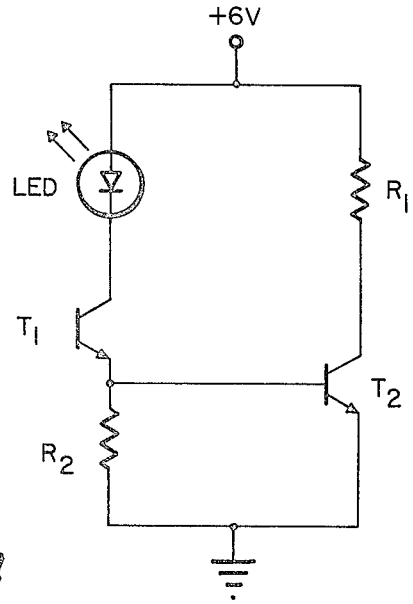
FIG. 3 is a schematic of the LED driver circuit of the structural moment detector of FIG. 2.
Figure 4:
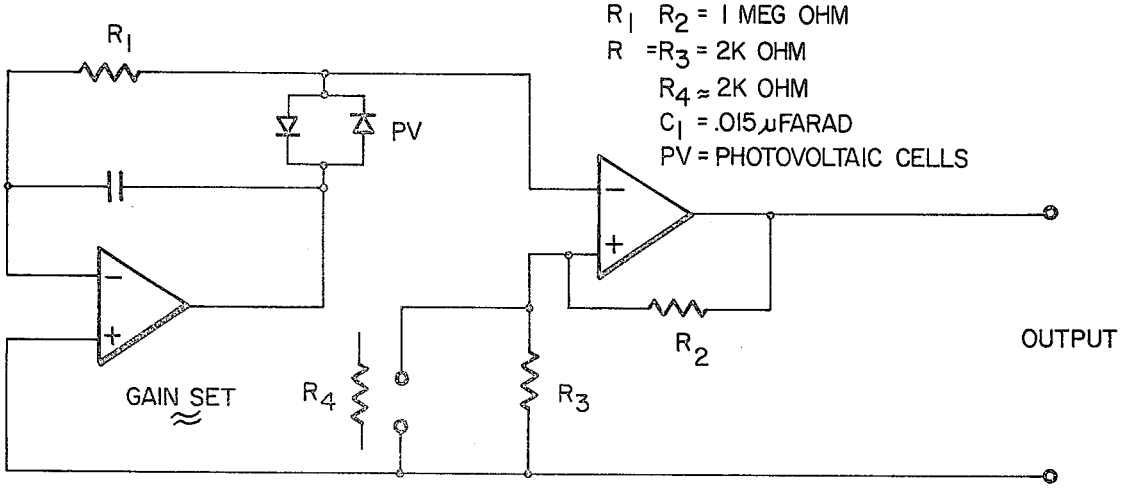
FIG. 4 is a schematic of the readout electronics circuit of the structural moment detector of FIG. 2.

Typical circuits which are used in conjunction with the mechanical components of the structural moment detector of FIG. 2 are illustrated in FIGS. 3 and 4. FIG. 3 is a schematic diagram of a suitable LED driver circuit which is a simple constant current source circuit which is required to provide a light source with constant light intensity. A typical suitable readout circuit is illustrated in FIG. 4, which depicts an analog output circuit consisting of a first stage self-nulling amplifier with common mode rejection and a second stage separational amplifier with relatively high gain.

The operation of the structural moment detector can be illustrated by reference to a simplified example of a cantilevered beam which is loaded and the structural moment detector is mounted at points a and b located equidistant from and on either side of a point midway between the beam support and the end of the beam. If the deflection of the beam is measured as $\theta$, the angle between surface tangents at points a and b, the output voltage of the photovoltaic cells is proportional to this angle and, according to the Area Moment Theorem $$V_{out} \propto \theta = \frac{\int_a^b M dx}{EI} = \frac{1}{EI} \int_a^b M dx$$

where

M is the applied moment between points a and b

E is the modulus of elasticity

I is the moment of inertia $\theta$ is the angular difference between surface tangents at points a and b x is the linear surface distance between point a and b.

If a load P is placed on the end of a beam of length L and $\delta$ is the distance between points a and b, then $$V_{out} \propto \theta = \frac{1}{EI} \frac{PL\delta}{2}$$

To illustrate the sensitivity of the structural moment detector, a load of 1 gram was placed on the end of an 8" cantilevered beam. The device was mounted at the midpoint on the beam such that points a and b were 1.5" apart. With this load $$V_{out} = 30 \text{ millivolts}$$

and $$\theta = 1.3 \times 10^{-7} \text{ radians.}$$

Since it is impossible to load a structure without changing the total moment which occurs between two points on the structure, it is possible to use the structural moment detector as an extremely accurate and extremely sensitive sensor having a range which far exceeds that of conventional volumetric intrusion detectors of the prior art.

Furthermore, the output of a structural moment detector can be converted by any appropriate transducer such as an electrically actuated tapper or a capacitive loader to securely transmit intrusion signals through the building structure, itself, to a central control point and to transmit signals back to a secure area from the control point to activate security system components, such as automatic door locking mechanisms, lights, audible alarms, disabling gas injecting systems, etc.

DESCRIPTION OF THE PREFERRED EMBODIMENTS

The operation and location of components of an intrusion alarm system incorporating the principles of the present invention and the various preferred embodiments thereof are schematically depicted by FIG. 1. As shown, a secure area 30 may contain a plurality of structural moment detectors (SMD's) 31 attached to various structural components of the building structure 32. The electrical outputs 33 of the SMD's 31 can be directly transmitted to the control center 34 or, in accordance with the preferred embodiment of the invention, the outputs 33 of the SMD's 31 are supplied to transducers 35 which convert the electrical intrusion signals 33 to mechanical forces 36 which are applied directly to the building structure and the resultant mechanical intrusion signals 37 are transmitted through the building structure 32 to the control center 34 where they are received by one or more SMD's 38 which produce secondary intrusion signals 39 which are transmitted to appropriate signal processing equipment 40.

The signal processing equipment 40 processes the secondary intrusion signals 39 in accordance with art-recognized techniques to reject spurious signals and to perform other signal-processing steps, such as time-of-arrival analysis to indicate the point of intrusion, comparison of footprint "signature" of the intruder with footprint signatures of authorized personnel to determine whether the intrusion is unauthorized, etc. Upon identification of secondary intrusion signals 39 as legitimate and unauthorized, the signal-processing equipment generates alarm signals 42 which are transmitted to alarm-activation equipment 43. The alarm-activation equipment activates various control center alarms and systems 44, various external alarms and systems 45 and various local security systems 46 located in the secure area 30. The activation signals 43*a* from the alarm activation equipment 43 can be transmitted electrically, directly to the local security systems 46 in the secure area 30 according to conventional prior art techniques. However, in accordance with a presently preferred embodiment of the invention, the activation signals 43*a* are applied to appropriate transducers 47 and converted to mechanical forces which are applied to the building structure 32 and transmitted therethrough as mechanical activation signals 48 which are received by activation signal receivers (SMD's) 49 located within the secure area 30, the output 50 of which is transmitted to and activates the local security systems 46 in the secure area 30.

As will be appreciated by those skilled in the art, the use of structural moment detectors as intrusion sensors provides significant advantages over conventional intrusion detector systems. Additionally, by coupling the sensors and the control center with transducers and additional structural moment detector devices, the intrusion signals and activation signals can be transmitted between the system components without the necessity of wires or an electronic field.

Having described our invention in such terms as to enable those skilled in the art to understand and practice it, and having identified the presently preferred embodiments thereof, we claim:

1. An intrusion alarm-security system for detecting unauthorized entry of persons into a defined secure area within a building structure, for generating and transmitting signals responsive to such intrusion and for activating security systems in response to such intrusion signals, said system comprising:

(a) at least one structural moment detector carried by a structural member of said building, located within said secure area, said structural moment detector generating intrusion signals responsive to the deflection of said structural member induced by changes of the loading on said member caused by an intrusion and being insensitive to linear distortions of said member;

(b) means for transmitting said intrusion signals to a control center; and (c) means in said control center for receiving said intrusion signals and for generating security system activation signals in response thereto.

2. In an intrusion alarm system for detecting unauthorized entry of persons into a defined secure area within a building structure, said system including sensor means for detecting an intrusion into said secure area and generating intrusion signals in response thereto, control means responsive to said intrusion signals for generating alarm signals, and means for transmitting said intrusion signals to said control means, the improvement comprising that the means for transmitting said intrusion signals comprises:

(a) transducer means in said secure area for converting said intrusion signals from said intrusion sensors to mechanical impulses and for applying said impulses to said building structure;

(b) a structural moment detector carried by said building structure for sensing deflections of said building structure by said impulses and for generating secondary intrusion signals; and (c) means for transmitting said secondary intrusion signals to said control means.

3. In a security system for activating security components located in a secure area within a building structure in response to intrusion into said secure area, said system including control means for generating security component activation signals, security system components located within said secure area, and means for transmitting said activation signals to said security system components, the improvement comprising that the means for transmitting said activation signals comprises:

(a) transducer means for converting said activation signals received from said control means to mechanical impulses and for applying said impulses to said building structure;

(b) a structural moment detector carried by said building structure in said secure area for sensing deflections of said building structure by said impulses and for generating secondary activation signals; and (c) means for transmitting said secondary activation signals to said security system components.

4. In an intrusion alarm-security system for detecting unauthorized entry of persons into a defined secure area within a building structure, for generating and transmitting signals responsive to such intrusion and for activating security systems in response to such intrusion signals, said system including sensor means for detecting an intrusion into said secure area and generating intrusion signals in response thereto, security system components located within said secure area, control means responsive to said intrusion signals for generating activation signals for said security system components, and means for transmitting said intrusion signals from said sensor means to said control means and for transmitting said activation signals from said control means to said security system components, the improvement comprising that the means for transmitting comprises:

(a) transducer means in said secure area for converting said intrusion signals from said intrusion sensors to mechanical impulses and for applying said impulses to said building structure;

(b) a structural moment detector carried by said building structure for sensing deflections of said building structure by said impulses and for generating secondary intrusion signals;

(c) means for transmitting said secondary intrusion signals to said control means;

(d) transducer means for converting primary activation signals received from said control means to mechanical impulses and for applying said impulses to said building structure;

(e) a structural moment detector carried by said building structure in said secure area for sensing deflections of said building structure by said impulses produced from said activation signals and for generating secondary activation signals; and (f) means for transmitting said secondary activation signals to said security system components.

* * * * *